United States Patent [19]

Dark

[11] Patent Number: 4,848,600

[45] Date of Patent: Jul. 18, 1989

[54] SELF CLOSING DISPENSING VALVE

[76] Inventor: Richard C. G. Dark, 8553 Red Hill Country Club Dr., Rancho Cucamonga, Calif. 91730

[21] Appl. No.: 41,305

[22] Filed: Apr. 23, 1987

[51] Int. Cl.[4] ..... B65D 25/40

[52] U.S. Cl. ..... 222/498; 222/501; 222/517; 222/518; 222/541; 222/556; 222/559

[58] Field of Search ..... 222/498, 501, 511, 517, 222/518, 541, 542, 544, 545, 556, 559, 560, 561, 505

[56] References Cited

U.S. PATENT DOCUMENTS

| | | | |
|---|---|---|---|
| 2,272,798 | 2/1942 | Hacmac | 222/517 |
| 2,502,821 | 4/1950 | Brauner | 215/78 |
| 2,857,919 | 10/1958 | Lerner et al. | 222/518 X |
| 3,120,908 | 2/1964 | Szajna | 222/511 |
| 3,315,850 | 4/1967 | Gran | 222/518 X |
| 3,584,834 | 6/1971 | Reid et al. | 222/518 X |
| 3,782,602 | 1/1974 | Page | 222/518 X |
| 3,853,250 | 12/1974 | Alpern | 222/517 |
| 3,948,422 | 4/1976 | Micallef | 222/517 |
| 4,158,902 | 6/1979 | Chernak et al. | 16/150 |
| 4,169,548 | 10/1979 | Bond | 222/505 |
| 4,346,810 | 8/1982 | Kneissl | 215/237 |
| 4,377,247 | 3/1983 | Hazard et al. | 222/517 |
| 4,386,720 | 6/1983 | Speedie | 222/498 |
| 4,444,340 | 4/1984 | Bond | 222/498 |
| 4,478,242 | 10/1984 | Bond | 222/559 X |
| 4,589,577 | 5/1986 | Welsh et al. | 222/559 X |
| 4,600,127 | 7/1986 | Malpas et al. | 222/501 X |
| 4,623,077 | 11/1986 | Schwartzbaugh | 222/517 |
| 4,687,123 | 8/1987 | Hyde | 222/518 |
| 4,693,400 | 9/1987 | Frahm et al. | 222/518 |

*Primary Examiner*—Joseph J. Rolla
*Assistant Examiner*—David H. Bollinger
*Attorney, Agent, or Firm*—Roth & Goldman

[57] ABSTRACT

A one piece self closing dispensing valve of molded polymer material is used in combination with a beverage container. The valve is of the kind containing a movable actuator which in response to a force applied thereto by a user, such as pressure exerted by the users finger, opens the valve to dispense liquid under force of gravity. A leaf spring operable over the range of actuator movement and normally biasing the actuator responds to the withdrawl of the applied force to return the actuator to its normal position and thereby close the valve. An integral dripless spout is defined between the actuator and the valve body; the effective size of which is inversly dependent on the position of the actuator.

48 Claims, 3 Drawing Sheets

SELF CLOSING DISPENSING VALVE

FIELD

My invention relates to dispensing closure valves for containers and, more particularly, to a self closing molded plastic valve for containers of the flexible wall type.

BACKGROUND OF THE INVENTION

One type of container for liquids in common use is of the flexible or bag type commonly known as a "bag in the box". In that container, a dispensing closure valve is attached to the bag for dispensing the contents, such as milk or, more commonly, wine. Another type of beverage package is constructed of a leak proof cardborad aluminum foil laminate. The dispenser valve is attached to the lower portion of the package and is subjected to fluid pressure. The beverage supplier packages the beverage and supplies the local supermarket where the package is placed on the shelves and made available for purchase by the consumer. Following the purchase of the product, the consumer dispenses the beverage into an awaiting cup by simply applying finger pressure to a simple push button or actuator. That action opens the valve; and beverage flows out the spout and fills the waiting cup. Unlike beverage packaging constructions using a cap, even a recloseable cap, one need not pick up and tilt over the container to pour out the beverage.

These products remain on the store shelves until the product is purchased, which could be for some long period. The valve must thus initially have a suitable "shelf life" over which it does not leak. Further the beverage is not always consumed at one sitting, except perhaps in the case of Australians. Hence to be effective, the valve, which is subjected to the hydrostatic pressures of the standing confined fluid, cannot allow any of the confined fluid to seep. Beverage containers of this type are not intended to be re-usable. Consequently when the container is emptied, the package is discarded, whether in the garbage pail or, unfortunately all too often, along the roadside. In those packaged goods applications, the closure valve must necessarily be a low cost element of the beverage package system so as to maintain the product price overall attractive to the consumer. Bronze valves thus do not do in this application.

No matter how effective the valve structure may be as a means to open and close a fluid passage, it must be easy to operate. If it requires too large a force to do so or if the valve is awkward to the grip or touch, the valve is not satisfactory to this use.

The aforementioned needs in a dispensing valve for packaged beverage application, particularly the requirement of low cost, have been addressed previously through the use of plastics and modern injection molding techniques for fabricating the elements of the valve with which those skilled in the art are familiar. Some valve constructions are more effective than others. The reader who wishes to be more fully acquainted with those forms of inexpensive plastic valves that have achieved a degree of acceptability in this application may visit the local supermarket and inspect the existing packaged beverage product.

The patent literature describes injection molded plastic dispensing valves useful in this application. For example the patent to Swartzbaugh U.S. Pat. No. 4,623,077, which issued Nov. 18, 1986, describes a dispensing valve of a construction containing a pushbutton that has a toggle like "snap" action created by a spring like action of a plastic diaphragm. When operated the valve may remain open until deliberate action is taken to re-operate the actuator and close the valve. Other patent literature describes alternative forms of such "toggle" type valves. Although presented in an attempt to avoid one practical difficulty, the difficulty which the consumer faces in holding existing designs of push button valves in the open state, the toggle type valves are unacceptable in my view, a view which I believe may be shared by those in the industry, because of the problem of the consumers inattentiveness. Adults who imbibe too much wine during a party that takes place in a nicely carpeted living room area, for example, could have their senses dulled or their minds distracted. It may be too late to realize that the person forgot to turn off the valve. An expensive carpet may be damaged or someone may have slipped in the liquid and fallen as a result. With no warning label on the packagae, the beverage supplier may fall victim to legal proceedings and be held responsible for the damage caused by the customer's inattentiveness. In the case of children of tender years who may be accustomed to opening a carton or bottle cap and tilting over a milk carton to spill milk into a glass with minimal spillage, use of toggle action type valves could be a messy education.

U.S. Pat. No. 4,386,720 granted June 7, 1983 to Speedie also shows a toggle type valve for a wine container. Speedie suggests welding a plastic membrane over the orifice closing diaphragm, in order to minimize an oxygen migration problem by the addition of a membrane of better material; a device, requiring added manufacturing expense. It should be noted that if the valve actuator in the Speedie valve is not moved far enough to effect the toggle action and the actuator is prematurely released the valve will close. Speedie extends that effect by mentioning the possibility that valve illustrated in the patent may be made self closing, which is in the context of a valve molded ideally in a single piece. One of the more popular self sealing dispensing valves is described in U.S. Pat. No. 4,444,340, granted Apr. 24, 1984 to Bond. That valve structure is essentially a plug made of elastomeric material which acts as a plug on an associated fluid confining chamber. When the plugs shape is distorted by means of a protrusion in the center of the plug, a passage is opened and fluid flows from the associated container and leaks past the distorted area. This type of spigot or valve in my opinion cannot withstand any reasonable pressures which may be exerted upon it as its elastomeric nature has a tendency to flex and leak. Further in actual practice the type of valve shown in Bond is difficult to operate. A waitress who needs to fill wine glasses from a bulk container in the course of business who is required to frequently manipulate this valve may find that she has sore fingers and thumbs; thereafter she might unconsciously influence the customers selection of wine.

Another valve that has achieved wide acceptance is manufactured by Waddington & Duval, Ltd. a company based in England. The valve contains a plug supported on a stem and a spring diaphram push button combination. By manually depressing the pushbutton with the thumb, the plug is moved essentially axially and uncovers an orifice through which fluid passes. And the diaphram spring functions to make this valve self closing. Most users are satisfied with the Waddington valve. It has good flow characteristics, reasonable sealing abilities and is relatively easy to operate. However, this valve is expensive. Its elements are not formed in one piece, but four individual components, if an overcap is included, and three individual components otherwise. Each of the elements are made in a separate molding operation. They must be inventoried and assembled together. Those activities require time, space and people, which adds to the manufacturing cost. Another multipart self closing valve intended for application in a "bag in the box" application is presented in Hyde U.S. Pat. No. 4,687,123.

An object of my invention, therefore, is to provide a self closing valve spout that is of novel and inexpensive structure; It is a further object of my invention to provide a dispensing closure valve for use with packaged liquids that has an acceptable shelf life and does not allow the confined liquid to seep or leak out of the package; It is a still additional object to provide a closure valve that may be more easily manufactured than prior valves that addressed the same application and that can be manufactured from a single piece of plastic material using conventional injection molding technique.

SUMMARY OF THE INVENTION

A one piece self closing dispensing valve of molded polymer material is used in combination with a beverage container. The valve is of the kind containing a movable actuator, which in response to a force applied thereto by a user, such as pressure exerted by the users finger, opens the valve to dispense liquid under force of gravity. A leaf spring operable over the range of actuator movement and normally biasing the actuator responds to the withdrawl of the applied force to return the actuator to its normal position and thereby close the valve. An integral dripless spout is defined between the actuator and the valve body; the effective cross section size of the spout is inversly dependent on the position of the actuator.

In more specific aspects my invention encompasses a self closing valve formed through molding of a single matrix of plastic material that includes a manually operated actuator member and a main body portion joined together by a strap or hinge in an integral or one-piece assembly. The main body of the valve includes a chamber containing a fluid passage or orifice in a face plate or wall. The actuator member supports a plug that is of slightly larger size than the orifice; and the geometry is such that as the actuator member is folded over about the hinge into assembled position in the main body portion, the force applied to the actuator pushes the plug through the orifice into the chamber for closing the orifice. A spring member, particularly a leaf spring, that functions with or as part of the actuator member, produces a biasing force on the actuator. The direction of the bias force is opposite to the prior assembling force and is sufficient to ensure that the plug is seated in the orifice in the normal closed condition of the valve. In operation when the actuator is pressed and forced to move, the actuator in turn moves the plug away from and to the side of the orifice over a short arcuate path and, concurrently, further tensions the spring. The spring, together with any hydrostatic pressure of the confined fluid acting on the plug, forces the actuator back to its normal position responsive to release of the applied force, whereby the plug again seats in the orifice.

An additional aspect to my valve is that the underside surface of the actuator confronts the chamber wall to form a channel therebetween. This channel defines a spout for deflecting the fluid released through the orifice downwardly past the free end of the actuator member and out the valve. The cross section area and size of the channel varies inversly as a function of the distance between the chamber wall and actuator member. A further aspect to the invention is the inclusion of a pair of finger grips adjacent the actuator to assist the application of a finger force to move the actuator member. A still additional aspect of the invention is the inclusion in this combination of a backstop or limiters to engage and block excessive reverse movement of the actuator should movement in the reverse direction beyond the normal position be attempted as a result of unusually high pressures existing in the chamber.

The foregoing objects and advantages of my invention together with the structure characteristic of my invention, which was only briefly summarized in the foregoing passage, becomes more apparent to those skilled in the art upon reading the detailed description of a preferred embodiment of my invention, which follows in this specification, taken together with the illustrations thereof presented in the accompanying drawings.

DETAILED DESCRIPTION OF THE PREFERRED EMBODIMENTS

Figure 1:
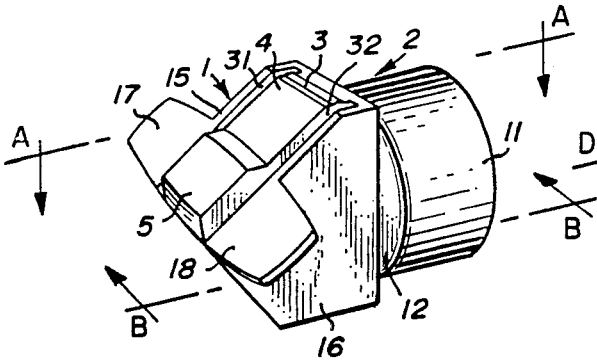
FIG. 1 illustrates an embodiment of my valve invention in front perspective view.

Reference is made to FIG. 1 in which a preferred embodiment of my valve is illustrated in a front perspective view. As shown, the valve contains a body portion 2 containing a generally tubular shape wall 11 joined to a face plate or wall 12, not fully illustrated in this figure, a mechanical push actuator member 1, containing a raised pushbutton like actuator portion 5. A pair of finger grips 17 and 18, one located on each side of the actuator, are supported by and extend at right angles to walls 15 and 16, respectively. In turn the supporting walls are connected to and extend at a right angle from chamber wall 12. The rear end of actuator 1 is integrally connected to one end of strip 4 and in turn the strip, which I characterize as a leaf spring, is integrally connected to a flexible strap formed by a recess or reduced thickness portion 3 in the strip and serves as a hinge type joint, which is described in greater detail hereafter connecting the actuator to wall 12. The clearance between the right and left sides of the actuator and the confronting grip member support walls is represented by 31 and 32, respectively, in the figure.

Figure 2:
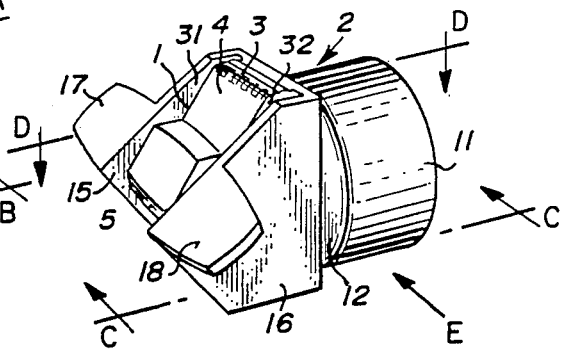
FIG. 2 is a perspective view of the embodiment of FIG. 1 in the fluid dispensing condition.

Turning to FIG. 2, in which the elements previously described are identified by the same numbers as before, actuator 4 is shown in an operated or depressed position as occurs when a finger force of sufficient level is applied to buttonlike actuator portion 5 and is moved through a short arcuate path toward chamber wall 12; and in which the upper end of the actuator member 1 remains essentially in the same position as before, In essence the bottom or free end of the actuator is pivotable or swingable toward the wall under the applied force and swings back to the normal position illustrated in FIG. 1, when the applied force is released, characteristic of the self closing feature that I present in my novel valve. A greater portion of the side support wall 15 for grip 17 is shown in this figure. Support wall 15 is oriented essentially parallel to its sister support wall 16 on the opposite side of the actuator.

Figure 3:
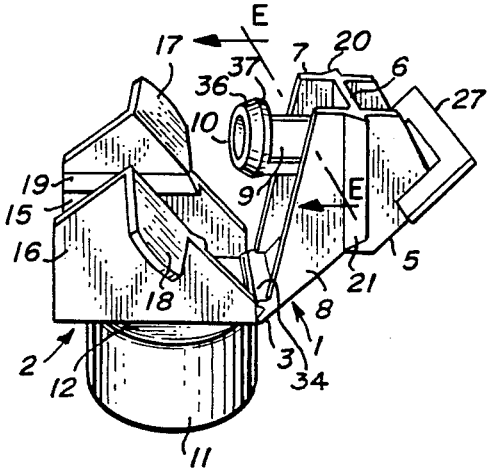
FIG. 3 illustrates the embodiment of FIG. 1 in its condition prior to assembly and with a protective tear off tab added.

FIG. 3 shows the plastic valve in an unassembled condition as it might appear following molding, and better illustrates the foregoing elements and additional elements of the valve, some of which are not visible in the two preceding figures. A plug 10 of circular cross section is connected by a connector or stem 9 to an underside wall 6 of the actuator member. The plug contains a front taper 36 of frusta-conical shape and the back end has a tapered surface 37 tapered in the opposite direction. The actuator carries two leading edges 20 and 21, which are wedge or ramp shaped elements, on opposite side walls 7 and 8, respectively. Similar wedges or leading edges 19 and 20, the latter of which is not visible in this figure, are formed in the inner side surfaces the side support walls of the finger grips. The actuator section 4 carries on the underside a protruding narrow bar 34 as labeled in FIG. 6 that is spaced a short distance from and extends parallel to the hinge. The exact function and relationships of the wedge elements and the protruding bar are described with more exactness following the description of some additional views. Further a flat U-shaped bracket, which I refer to as a "tear off" tab 27, has its ends attached to actuator 5. This element was not illustrated in FIG. 1. The tear off tab is discussed in connection with FIGS. 15 and 16 later in this specification.

The skilled reader may pause to consider that the complicated structure described is a unitary or one-piece assembly. That is, all of the elements are arranged to be formed in place attached together as shown by injecting fluid plastic into a single mold, allowing the plastic to cure or solidify in the mold, and removing the assembly as one single piece. Such a process is known as injection molding. Of course other kinds of molding processes may be used to obtain the molded polymer structure illustrated as the manufacturer desires. The relationship in position between actuator 5 and valve body 2 upon removal from the mold depends upon the particular configuration selected by the manufacturer. Thus the particular position illustrated in FIG. 3 is not limiting and is merely illustrative of one such pre-assembly configuration.

Figure 4:
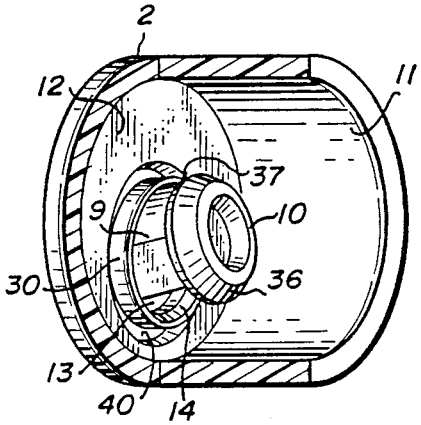
FIG. 4 is an enlarged partial perspective cutaway section view of FIG. 2 as viewed from the side in the direction of the arrow E.

The partial section view of the valve chamber illustrated in FIG. 4 is taken from the valve positioned as in FIG. 2 but is rotated and is drawn to an enlarged scale to illustrate more effectively the chamber wall 12, previously described, located at the end of the tubular chamber formed by cylindrical wall 11. A plurality of short small diameter axially extending cylindrical ribs, not illustrated, may be included. Those ribs would be attached to and extend from wall 12 and be attached to and extend along a portion of the inner surface of wall 12 to add rigidity. A passage or orifice 13 is shown that is of circular cross section. The orifice is surrounded by a protruding rim 30 which protrudes into the defined chamber a short distance beyond the major flat surfaces of wall 12; recognizing, however, that this rim element is also integral with the back wall 12. The inner end wall of the orifice rim is surrounded by a taper 14 or seal which mates with the taper 37 on the rear side of plug 10. This surface is also a frusta conical surface section that tapers toward the axis of the orifice to the other or left side of wall 12. A groove 40 recessed into the surface of wall 12 surrounds the protruding rim. This groove weakens the wall at this location to enhance its flexibility at that location, allowing rim 30 some slight axial movement. The geometry of plug 10, its front tapered surface 36, rear tapered surface, which is described elsewhere in this specification, and the hollowed central section are also further illustrated together with the connecting stem 9 in FIG. 4.

Figure 5:
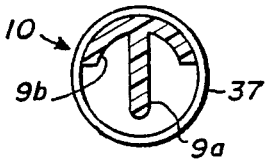
FIG. 5 is a cross section view of one element of the first embodiment taken along the lines E—E in FIG. 3.

FIG. 5 illustrates the preferred geometry of connector 9, and is a section view taken along the lines D—D in FIG. 3. As there shown in the section view, the stem consists of two elements **9*a* and 9*b* connected to the backside of plug 10. Element 9*a* is a rectangular strip or rib and element 9*b* is a semi cylindrical surface, the latter of which closely adjoins the rear seal surface 37 of plug 10**. The two elements give adequate strength for support of the plug and for the assembly of the valve.

Figure 6:
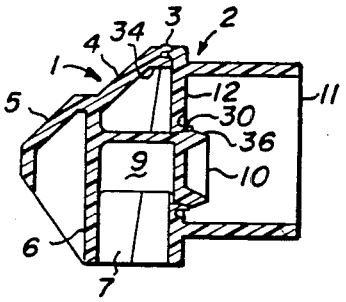
FIG. 6 is a section view taken along the lines A—A in FIG. 1.
Figure 7:
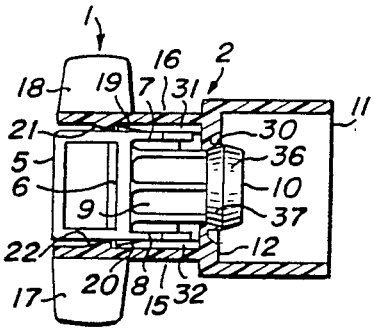
FIG. 7 is a section view as taken along the lines B—B in FIG. 1 which illustrates the valve in the normal closed condition.

The section views of FIG. 6 and FIG. 7, to which reference is now made, better illustrate the internal relationship of the elements of the valve in the unoperated state as viewed from the side of the valve and as viewed from the bottom of the valve, respectively. And the section views of FIGS. 8 and 9 better illustrate those same elements with the valve in the fully operated position to dispense liquid.

For ease of understanding, FIG. 6 through 9 are drawn to the same scale and correspond to the scale used in the illustrations of FIGS. 1 and 2. They give the reader better insight to even the details of structure, which though not necessary to the description of my invention, may benefit those of lesser skill in the valve arts.

As illustrated in FIG. 6 plug 10 is seated in the orifice with its tapered seal surface in mating abutting engagement with the seal in the protruding rim 30 formed in chamber wall 12. The stem includes a straight rib that connects to actuator wall 6 underlying the pushbutton portion 5. And the wall 6 is positioned confronting the wall 12 and, hence, the orifice; and wall 6 is joined at an end of strip 4 with which it forms an angle of approximately 135 degrees, but which maybe any angle between 90 and 180 degrees. The length of the stem is such that the wall or strip 4 is under a slight tension as a result of the cooperation of bar 34 and the engagement of that bar with wall 12. That is, the juncture or seal between the plug and the orifice is sufficiently strong to preclude the leaf spring portion formed of strip 4 from assuming a relaxed untensioned condition. The theory of this arrangement is described more fully in another portion of this specification.

The depending wall 7 is not of uniform depth. Its bottom edge as shown extends at an angle to chamber wall 12 and to actuator wall 6, from which it depends. The opposite actuator wall, not illustrated, is of like construction, in as much as the construction of the valve is essentially symmetrical about the mid-section plane of the valve as viewed in FIG. 1.

The elements thus described are shown from the bottom view in FIG. 7. There is no need to repeat the description of many of those elements, inasmuch as the reader may refer to the prior description as necessary. The ramp or wedge shaped leading edges 19 and 20 protruding from the actuator side walls 7 and 8 and the ramp or wedge shaped leading edges 21 and 22 protruding from the walls of finger grips 16 and 15, respectively, are better illustrated as is their relationship in which the straight sidewall portions of each set are positioned spaced slightly from and confronting one another. Clearance gaps 31 and 32 are provided between the sidewalls.

Figure 8:
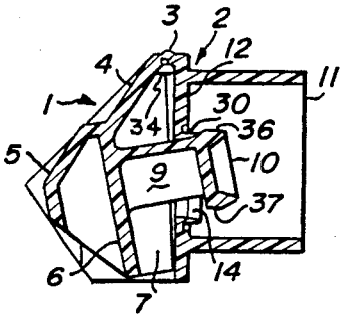
FIG. 8 is a section view of the valve invention taken along the lines D—D in FIG. 2 and illustrates the elements with the valve in the dispensing condition.
Figure 9:
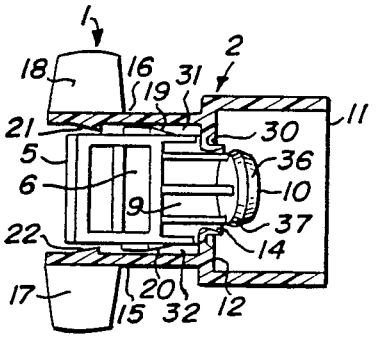
FIG. 9 is a section view taken along the lines C—C in FIG. 2 that further illustrates the elements of the valve in the dispensing condition.

In the operated position illustrated in FIG. 8 the actuator is pivoted into a new position with the plug positioned further within the chamber away from the chamber wall and in which the plug raised slightly off and above the axis of the orifice. And the upper semicylindrical surface of stem 9 abuts the upper side of the orifice wall. In this position the orifice is uncovered opening a passage through the chamber into the space between wall 12 and wall 6 of the actuator.

The actuator wall is positioned more closely to wall 12 in this condition than in FIG. 4 so that the size and cross section area of the passage is reduced in the transition from the normal unoperated condition to the fully operated condition. The fully operated position shown is defined by the position of the bottom edge of wall 7 which, as shown, abuts the wall 12 and prevents further travel of the actuator. The reader understands that the plug can be moved to intermediate positions which are not illustrated in which the valve is only partially opened as when the plug is moved a minute distance off of its seat in the orifice when the actuator is only partially depressed.

Given the foregoing description of the elements, attention is redirected to FIG. 3 and related figures previously described in connection with the following description of assembly and operation. Following the molding of the valve, the actuator 1 is generally at a right angle with respect to the body portion 2 in the unassembled position as illustrated in FIG. 3. The actuator is then manually swung over in an arcuate path about hinge 3 to the assembled position as represented in FIG. 1. During the assembly procedure leading edges 19 and 20 on the actuator engage leading edges 21 and 22 on the body 2 and as the inclined wedge surfaces slide past one another they wedge or force the finger grip side walls 15 and 16 apart (and the opposed actuator wall slightly inwardly), permitting the actuator to move past those protruding surfaces. The leading edges 19 and 21 and 20 and 22 contain flat side walls that are perpendicular to the walls from which they depend as shown in FIG. 7. As becomes apparent hereinafter those sidewalls are interlock surfaces that form a positive latch or stop, which prevents the actuator from being moved back to the unassembled position. A better illustration of the latch elements is discussed in connection with an additional embodiment in FIG. 16 to which reference may be made as desired. The advantage of the interlock or latch feature will become apparent to the reader hereinafter.

As the actuator is folded about hinge 3 during the assembly procedure it carries plug 9, which also swings around in an arcuate path. As the actuator passes through the stop limiters 21 and 22, the stem 9, acting as a drive rod, pushes the plug 10 through the orifice in chamber wall 12 and into the chamber defined within tubular walls 11. Plug 10 is slightly larger in diameter than the orifice. By way of specific example if one employs a general injection molding grade of homopolymer polypropylene the diameter of the plug at its maximum width can be one one-hundredth of an inch (0.010 inch) greater in diameter than the diameter of the orifice taken at its minimum width. Hence the leading tapered edge 36 serves both to align the plug coaxially with the orifice and, as the plug is forced therethrough, to smoothly and gradually expand the orifice opening without tearing the plastic. The inherent elasticity of the plastic and the added flexibility resulting from the groove 40 surrounding the orifice assists this mechanical operation.

The spring member or strip 4 is placed in tension or flexes during this assembly process by bending it about bar 34, which abutts wall 12. Upon release of the applied force during the assembly process, the spring action inherent in the elasticity of the plastic strip moves the plug axially to the left as shown in the drawing to a position with the rear end seal 36 of the plug seated in the tapered surface 14, shown in FIG. 4, of the orifice blocking the passage. Leaf spring 4 stores mechanical energy and creates the spring like force in the reverse direction and biases or spring loads the actuator creating a pulling force on the plug, which firmly seats the plug in mating engagement with the orifice. Conversely, the juncture between the plug and the orifice is sufficiently strong to resist the force of the spring and retain the spring in tension and the level of the spring force is not sufficient to cause de-assembly.

In normal operation the valve is assembled to the lower end of a container or reservoir, not illustrated, connected to the chamber formed by the tubular wall 11 by any suitable means, not illustrated. The package is filled with liquid that accesses the chamber. Consequently the outer chamber wall 12 and plug 10 are subjected to considerable hydrostatic pressure, the extent of which is dependent upon the height of the fluid in the package. By gripping grips 16 and 17 with the index and middle fingers and pressing the actuator button 5 with the thumb, the actuator is moved from the position shown in FIG. 1 (and FIG. 8). The spring strip 4 is further flexed about its pivot point to increase the tension therein and plug 10 is thus moved and raised in position as shown in FIG. 8. The confined fluid exits the chamber through the open passage and strikes the undersurface 6 of actuator member 1. The actuator member deflects the fluid stream downward through the passage and the free end of the actuator member to an awaiting cup or other container, which the user supplies. As the user releases the actuator, the spring flexed strip 4, releases stored energy and moves the actuator and the plug back to the normal position. The orifice is re-closed, shutting off the fluid flow.

The forward movement of the actuator is limited to the point at which the bottom edges of walls 7 and 8 abut wall 12. If for any reason the pressure within chamber 12 increases to such a level as could force the plug in the reverse direction through the passage, the slight initial movement in that direction causes the back edges of the leading edges 19 and 20 of the actuator to abut against the stops 21 and 22. The stops prevent the threatened de-assembly and enhances thus the usefulness of the valve.

The underside surface of the actuator and the wall 12, containing orifice 13, are in a confronting relationship. Together with the side walls 15 and 16, which depend from the side edges of the upper actuator surface, the surfaces define a passage or dispensing spout, oriented perpendicular essentially to the axis of the orifice, that extends through the free end of the actuator. The undersurface of the actuator deflects fluid entering the spout via the orifice downwardly through and out the spout.

The size and cross section area of the spout is variable and is inversly dependent upon the distance between walls 6 and 12 or, as alternatively viewed, is dependent inversly upon the amount of forward arcuate movement of the actuator. That is, as the actuator is moved more closely to wall 12 under an applied force, the cross section area of the spout becomes smaller. This reduction in cross section continues until the edges of the side walls 15 and 16, which serve as stops or limiters, abuts against the chamber wall 12 to define the minimum cross section thereto concurrently with the actuator then being in the fully operated position.

A further feature of my unique construction allows the spout to be "dripless". If a partial vacuum is created in a spout following closure of a valve, the vacuum will retain or hold some fluid, which will be released or "drip" out the spout as the vacuum gradually dissipates. The clearance gaps 31 and 32 between the side walls 15 and 16 and the corresponding side walls 7 and 8 form vents, venting the upper end of the spout passage to the atmosphere. Hence a partial vacuum cannot form in the spout upon closure of the valve.

Figure 10:
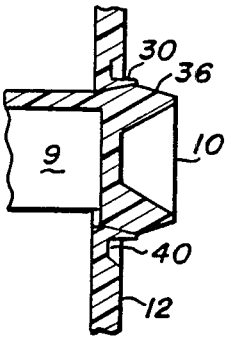
FIG. 10 shows the valve plug and the orifice of FIG. 6 in a partial section view in enlarged scale in a position with the valve closed.

For the person who wishes to become aquainted with further details of my novel valve one's attention is directed to the additional illustrations of selected elements in FIGS. 10 through 14. Plug 10 and a portion of the supporting stem 9 are illustrated in section view and in a larger scale than the preceding figures, first, in the normal position in FIG. 10 and, secondly, in the fully operated position in FIG. 11. These illustrations correspond to the positions of those same elements presented in FIGS. 6 and 8 previously discussed. As shown in Fig. 10 the front of the plug contains a tapered leading edge 36, essentially a frusta conical surface section, which tapers toward the axis of the plug toward the front of the plug to the right as viewed in the figure; and contains a hollowed out central region. The front taper acts as an expander to align the plug into the orifice during assembly of the valve and gradually expand the orifice to allow the plug to pass through. To the rear of the plug is a tapered edge 37, also frusto conical in geometry, which also tapers toward the plug axis, but does so to the rear of the plug; to the left as viewed in the figure.

The orifice is surrounded by a tubular wall integral with chamber wall 12 and which protrudes beyond the major rear surface of that wall. A shaped groove 40 in the outer surface of wall 12 surrounds the protruding orifice wall. The groove in the surface reduces the wall thickness at that location increasing the flexibility of the orifice wall. That is, the orifice wall can be moved axially back and forth to a slight degree, allowing the wall to yield to some extend during assembly and operation of the valve and not break or cause binding. The inner surface of the orifice wall contains a tapered edge 14 of similar size and geometry of the plugs rear tapered edge 36 to form a seal seat. The seal mates with the seal surface of the plug when the latter is in the normal position as illustrated in FIG. 10. Although the seal tapers are shown as substantially similar, they need not be the same taper as those skilled in the art understand.

Figure 11:
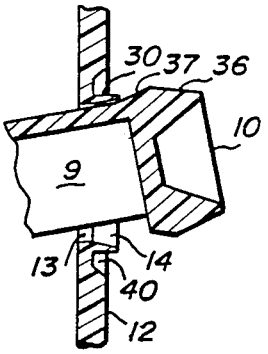
FIG. 11 illustrates the valve plug and the orifice of FIG. 8 in a partial section view in enlarged scale in a position with the valve fully operated.

Comparing the plugs position in FIG. 11 with that in FIG. 10, when in the fully operated position the end of the plug is located at a position which is along the axis further away from wall 12 than before and the end thereof is also located in a slightly raised position. The plug was thus moved through a short arcuate path up and to the right from the normal position in which the valve is closed.

Figure 12:
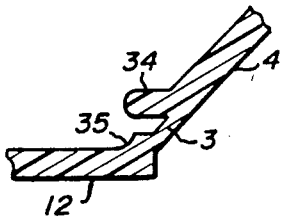
FIG. 12 illustrates another element of the first embodiment, a strap or hinge joint, in a partial section view drawn to enlarged scale and in the condition prior to assembly as in FIG. 3.
Figure 13:
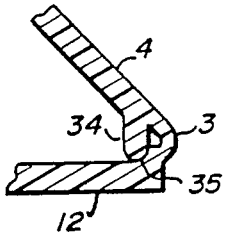
FIG. 13 shows to enlarged scale and in partial section the element illustrated in FIG. 12 when the valve is in closed condition following the valves assembly.

The hinge joint and spring construction are illustrated in section to an enlarged scale in FIG. 12 and FIG. 13 and the reader recognizes the elements previously described as the upper end of chamber wall 12, hinge 3, strip 4 and protruding rib or bar 34. The upper end of the wall surface contains a shoulder or ridge 35, that is a small portion of plastic raised from the major surface of the wall 12 continuous with end of hinge 3. The bar carried by the spring strip 4 is formed at a minor angle, al, with respect to the plane of strip 4. The strip 4 is shown in the unassembled position. When swung or folded over by rotating about the hinge 3 during the valve assembly process, a certain point is reached in which the bar as shown in FIG. 13 abuts the wall 12 and is braced against ridge 35 at essentially a right angle to the surface of wall 12 so that it cannot move upward along strip 4 toward the plastic hinge as further pressure is applied on strip 4. At this point further movement of strip 4 causes the strip to flex or bend about the bar, which serves as a fulcrum since the rear end of the strip cannot move further. As a consequence the spring member flexes and is placed in tension. In effect the pivot point of the actuator has shifted from the hinge to the point of engagement between the bar and the ridge.

In the normal closed position of the valve and, hence the normal position of spring 4, the spring member is in slight tension, biasing or pre-loading the actuator. When activating the valve, the leaf spring member flexes; and upon release of the valve actuator, the spring returns to the normal position with the pre-load aforedescribed.

Figure 14:
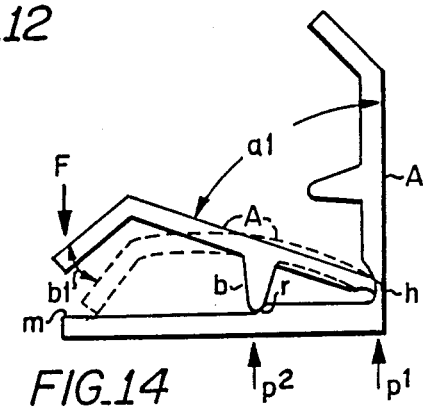
FIG. 14 is a symbolic illustration of the actuator member and spring in three positions of assembly and operation of the valve.

In FIG. 14 I symbolically represent the strip or actuator portion by a bent arm A, having two portions forming an angle of perhaps 135 degrees between the portions. The arm is shown first in the unassembled position, essentially upstanding at a right angle to the surface, m, representing the chamber wall or other appurtenant surface of the valve body. Secondly, the arm is shown in the assembled normal position, attained after it has been bent or folded over about the hinge section, represented by the letter h, representing an angular positional change of al about a pivot point pl. And in that position the protruding bar abutts surface m and ridge r and is in slight tension, not illustrated. Thirdly, the arm is represented as having its end pushed further by an applied force F on arm portion 12 so as to have flexed through an additional angle bl about the bar b, which serves as a fulcrum or pivot point p2. The exaggeration permitted by this symbollic illustration should assist the less skilled reader to understand the specific embodiment earlier described.

The foregoing illustration also serves to demonstrate the broad nature of my invention in an improved valve unencumbered by specific details inherent in the preferred embodiment. Clearly the effects that I have achieved and described in this specification may be accomplished by varying the shape of the arm and the surface, and by reversing the position of the parts, such as the bar like protrusion, consistent with the requirements for molding the valve as a single piece. Moveover I have used terminology to describe the arm overall as an actuator member and a section of it as a leaf spring and another portion simply as an actuator, demonstrating perhaps not a limitation to my invention, but a limitation to existing language with which new things must be described. With equal effect the actuator member may be regarded as a actuator with an integral leaf spring and the spring in turn as a coupling means which couples the actuator to the hinge; a multitude of functions within a single plastic strip. As described hereinafter in connection with a less preferred embodiment, the leaf spring may be made as a separate strip dependent from the arm, although integrally attached. In that case the leaf spring does not serve also as the coupling to the hinge.

The valve is molded of a flexible plastic, a polymer, that has a good memory and minimum creep characteristics to attain the spring action without losing its flexibility as required for an effective valve seat. For example, polyethylene is flexible, but has poor creep and memory characteristics. Polypropylene on the other hand is better and some grades are excellent. Other plastics such as acetal and nylon have even better memory with a minimum creep, but are less flexible. One plastic I have found acceptable at the present time is made by Rexene. It is a homo-polymer polypropylene 11 S 30 and has a flex modulus when measure on the ASTM scale D 790 of 200,000 and a deflection temperature (ASTM D 684) of 216 degrees Fahrenheit. As those skilled in the art appreciate other polymers are now available or will become available which will have better or worse performance characteristics and still perform in the combination I have disclosed in this specification.

An improvement to the embodiment is presented in FIG. 14 in which the valve of FIG. 1 is modified to incorporate a tear off tab 27. That element was briefly noted earlier in connection with the description of FIG. 3. The tab is integrally molded with a thin section 38 and 39, better illustrated in the next figure, attached to activating button 5. The tab forms a barrier that prevents movement of actuator 5 and, hence, prevents the valve from opening until the tab is removed. Removal is accomplished by simply tearing it off. Should the actuator be accidentally bumped while tab 27 is in place the valve, cannot open.

Figure 15:
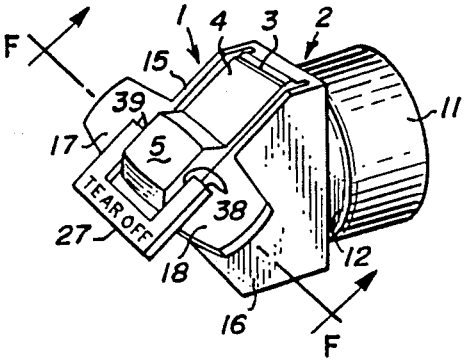
FIG. 15 is a perspective view of the embodiment of FIG. 1 with the tear off tab modification.
Figure 16:
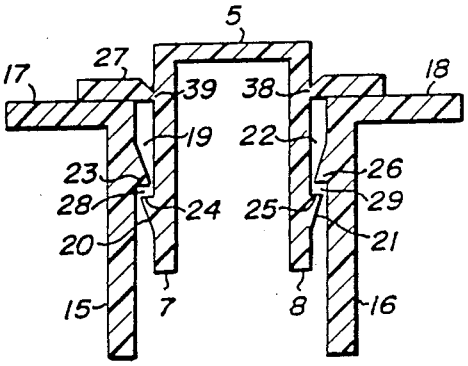
FIG. 16 is an enlarged scale section view of the embodiment of FIG. 15 taken along the section lines F—F.

A section view taken along section lines F—F in FIG. 15 is presented in FIG. 16 and illustrtes more completely the attachment of the tear off tab and the high pressure interlock or limiter. As shown in this figure the spacing between the interlock or stop limiter surfaces 23, 24, 25 and 26 when the valve is its normal unoperated position is a small gap represented by 28 and 29. If pressure should start to build up in the fluid chamber, the pressure exerted on the plug acts to force the plug more firmly into its sealed position in the orifice. If the pressure becomes slightly larger the pressure forces the actuator backwards so that the surfaces of the interlock limiters come in contact with each other to prevent further reverse movement of the plug and the plug cannot be forced through the orifice.

Figure 17:
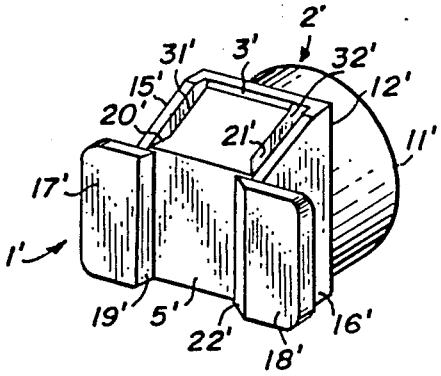
FIG. 17 illustrates another embodiment in front perspective view.
Figure 18:
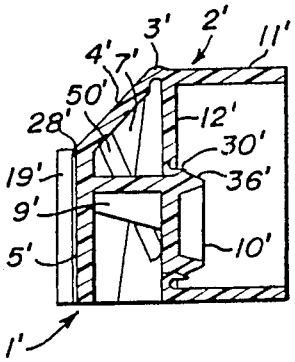
FIG. 18 illustrates a section view of the embodiment of FIG. 17.

The embodiment of the invention illustrated in FIG. 17 in front perspective view is of a different appearance and a slightly different construction. However for convenience where the elements in this embodiment perform the same essential function as in the prior embodiment I employ the same identifying number primed. The valve of this embodiment is formed in one piece and assembled in the same way as the prior embodiments. The explanation of the functions and mode of operation, thus, need not be repeated. As shown in the section view of FIG. 18 in this structure the leaf spring 50 is a strip which protrudes and depends from strip 4' and abutts the surface of wall 12. The design of the geometry is such that the spring is bent slightly and, because it is of an elastic characteristic, is in a slight tension to bias the actuator member. As the actuator is moved toward the wall, the spring is bent further increasing the force that it stores. Upon release of the actuator, the spring returns the actuator to the normal position.

Although the leaf spring in this embodiment is not totally integrated into the plane of the actuator and/or the actuator coupling it none the less is an alternate form and provides the spring like function necessary to self closing valve action. Although this additional embodiment is useful to demonstrate the nature and scope of my invention, it is less preferred than the structure of the first embodiment.

As described earlier in this specification, the valve is formed by injection molding and, as removed from the mold, appears as illustrated in FIG. 3, unassembled, as a specific example. After molding the valve is left to "set" or stabilize prior to assembly into the form illustrated in FIG. 15 and FIG. 1. During this time the warm plastic cools to ambient temperature. This allows hinge 3 to retain a "memory"; the hinge acquires a stiffening or spring like characteristic. Hence following assembly of actuator 5 into the valve body, hinge 3 creates a spring like return force that contributes to the biasing force created through flexing of actuator strip portion 4 about bar 34, as best illustrated by way of example in FIG. 13 and also shown in the other figures.

Alternatively, the valve may be assembled immediately following the molding procedure. In the latter case, the molecules in the hinge become aligned, providing a "living" hinge; one that may be flexed indefinitely, but which does not have the spring like characteristic. This "living" hinge is more analogous to an ordinary metal gate hinge or leather strap hinge and non-analygous to an ordinary spring loaded gate hinge. In as much as the hinge in this valve is flexed only once in normal use, which occurs during assembly of the valve actuator into the valve body, the advantage of indefinite flexing is unnecessary in this application. Conversely, the spring like quality of the first described construction is preferred.

The preferred embodiment of FIGS. 1 and 15 and the embodiment of FIG. 17 includes a wax film or coating. The wax coating, not illustrated in the figures, covers the inner part of the chamber 11 as viewed in FIG. 6 and covers all of the inner walls, including chamber wall 12 and plug 10 and is impervious to gas. The wax coating is applied following the assembly of the valve by inserting a nozzle from the rear side along the axis of the chamber and spraying the walls with the liquified wax.

The coating or "osmosis barrier" is a particularly useful addition. It prevents the entry of gas, such as air, by osmosis through the polypropelene material of the valve to the confined fluid. This is important where the fluid is an alcoholic beverage. The entry of air into the alcoholic beverage even by osmosis changes the taste and quality of the beverage.

When the valve is initially operated, the movement of the actuator causes the plug to break the barrier layer in the peripheral film barrier in an area around the end of plug 10, however, the remaining portions of the coating or barrier continue to serve that function inhibiting osmosis. An alternative to the wax is polyvinyl alcohol, which also forms a impervious film. It is noted that if the film is too strong, it may stretch rather than break. That would require modification to the design of the front end of the plug to allow it to cut through the film. The film layer is very thin, on the order of thickness of a layer of polish applied to an automobile when polishing the automobiles surface. Thus each of these barrier layers is applied to a thickness of at best a few ten-thousandths of an inch.

I believe that the foregoing description of the preferred embodiments of my invention is sufficient in detail to enable one skilled in the art to make and use the invention. However, it is expressly understood that the detail of the elements which I have presented for the foregoing purpose is not intended to limit the scope of my invention, in as much as equivalents to those elements and other modifications thereof, all of which come within the scope of my invention, will become apparent to those skilled in the art upon reading this specification.

By way of example, I have described a construction in which the walls of orifice 12 are flexible and in which a rigid plug 10 may thus be pushed through the orifice in assembling the valve. However an alternative arrangement in this combination may include a compressible plug and a more rigid orifice wall, wherein the plug will be squeezed and compressed in order to pass through the orifice, although such would be a more difficult and less desirable design. And, of course, combinations of both could be used consistent with plastics technology as those skilled in the art appreciate.

As further example the construction described allowed the leading edges of the actuator to spread apart side walls 15 and 16 during assembly. Consistent with my invention it is possible to have the side walls of the actuator squeezed inwardly as an alternative if the side walls of the finger grips are chosen to be more rigid. And a combination could be used with the walls of the finger grip spreading outwardly to a degree and the sidewalls of the actuator being squeezed inwardly to a degree as the actuator moves through the passage between the finger grips into assembled position. As a last example Stem 9 supporting the plug has one surface that is semi tubular and contains a central rib. Although that construction is preferred other configurations are also permissible, such as a stem of "T" shaped cross section.

Thus my invention is to be broadly construed within the full scope of the appended claims.

what I claim is:

1. A dispensing valve for a fluid container, which comprises in a unitary molded assembly of flexible polymer plastic material:

actuator means for moving a plug means, said actuator means including first and second strip portions joined together at an end, at least said first strip portion having an elastic characteristic;

a valve body, including chamber means for confining a fluid;

said chamber means including an orifice;

hinge means joining one end of said first strip portion to said chamber means for coupling said actuator means to said chamber means;

said plug means being coupled to said second strip portion of said actuator means, said plug means being responsive to movement of said actuator means toward said chamber means for at least partially opening said orifice and being responsive to movement of said actuator means away from said chamber means for closing said orifice;

fulcrum bar means for providing a fulcrum, said fulcrum bar means oriented transverse to said first strip portion and being spaced a predetermined distance from said hinge means and contacting both said first strip portion and said valve body means;

said actuator means being responsive to an applied force on a surface of said second strip portion for moving at least a portion thereof toward said valve body means;

wherein movement of said second strip portion toward said chamber means in response to a force applied to said actuator means forces said first strip portion to elastically flex about said fulcrum bar means to create a restoring force in said actuator means, whereby responsive to release of said applied force said actuator means moves away from said valve body means.

2. The invention as defined in claim 1 wherein said second strip portion of said actuator means is located in confronting relationship with said orifice and defining with said chamber means a spout passage for dispensing fluid exiting said orifice; and wherein said first strip portion and said second strip portion of said actuator means define an angle therebetween of less than 180 degrees and more than 90 degrees.

3. A one-piece self closing molded polymer liquid dispensing valve comprising:

fluid orifice means for discharging fluid from a fluid reservoir, said orifice means having front and rear sides;

plug means located on one side of said orifice means for opening and closing said orifice means to fluid flow, said plug means having a normal position covering said orifice means to inhibit fluid flow;

mechanical valve actuator means located on the other side of said orifice means movable in position toward said orifice means in response to application of a manual force applied to said actuator means; and connecting means connecting said plug means with said actuator means for moving said plug means responsive to movement of said actuator means; and spring means for applying a force to said actuator means over the range of travel of said actuator means in a direction opposed to the direction of movement of said actuator means effected by said manual force applied to said actuator means for restoring said actuator means to a normal position responsive to withdrawal of said applied manual force;

said actuator means having a free end portion defining a wall of a spout through which fluid flowing from said orifice means is channeled, said spout being variable in cross sectional area as a function of the position of said movable actuator means with respect to said orifice means; and mounting means for mounting said actuator means for movement in an arcuate path, whereby said plug means is moved from said normal position in an arcuate path in a direction away from and to one side of said orifice means.

4. The invention as defined in claim 3 wherein said spring means comprises: a strip of plastic material; wall means for providing a barrier; means integrally connecting one end of said strip to said wall means; means integrally connecting the opposed end of said strip to said valve actuator means for movement of the end therewith; a bar located between said strip and said wall means proximate the juncture between said strip and said wall means and oriented transverse to said strip to form an abutment therebetween, whereby movement of the other end of said strip toward said wall means creates a bending moment in said strip about the location of said bar causing said strip to bend and the flexural elasticity of said plastic material creates a restoring force in said strip.

5. The invention as defined in claim 4 wherein said bar is attached to the underside of said strip.

6. The invention as defined in claim 5 wherein said plug connecting means connecting said plug means to said actuator means comprises:

a first length of plastic material of semi cylindrical shape having the axis thereof oriented essentially parallel to and coaxial with the axis of said plug means;

an elongated rib extending along the inner surface of said first length of plastic material between said plug means and said actuator means; and said surface of the semi-cylindrical portion being oriented over the axis of said plug means, whereby as said plug means is moved said cylindrical surface contacts and brushes against the upper portion of said orifice to inhibit flow of fluid from there above and promote the flow of fluid through the orifice means from a position there beneath.

7. The invention as defined in claim 5, further comprising: shoulder means protruding from said wall means for engaging said bar and preventing said bar from moving in the direction of said mounting means.

8. The invention as defined in claim 4, further comprising: plastic strap joint means for hingedly connecting said strip to said wall means.

9. The invention as defined in claim 4 wherein said bar contacts said wall means and said strip of plastic material responsive to said actuator means being in the normal position, said strip of plastic material being under a slight tension; and wherein said plug means and said orifice means restrains said strip of plastic material from moving away from said normal position in a direction away from said wall means.

10. The invention as defined in claim 3 wherein said valve actuator means contains a rear surface spaced from and confronting said said orifice means for deflecting fluid passing through said orifice means toward said free end of said valve actuator means to define between said rear surface and said orifice means a spout through which fluid is dispensed, and wherein the cross sectional area of said spout is variable in response to movement of said actuator means toward said orifice means.

11. The invention as defined in claim 3 wherein said valve actuator means contains right and left side ends and contains right and left side walls depending therefrom in a direction toward said orifice means for limiting the movement of said valve actuator means toward said orifice means to a predetermined distance and for further defining said spout.

12. The invention as defined in claim 3 further comprising: stop limiter means for preventing movement of said valve actuator means beyond a predetermined normal position in a direction away from said orifice means for preventing a force applied to said plug means from pushing said plug means from the one side through to the other side of said orifice means.

13. The invention as defined in claim 12 further comprising: a pair of finger grip means coupled to said wall means for providing a surface to support fingers, a first one of said pair being located on one side of said valve actuator means and the other one of said pair being located on an opposed side of said valve actuator means.

14. The invention as defined in claim 13 wherein said valve includes: a pair of side walls with said side walls extending from said wall means; with one of said side walls supporting one of said finger grip means in spaced relation with said orifice means and the other of said side walls supporting the remaining one of said finger grip means in spaced relationship with said orifice means; and wherein said stop limiter means includes: a pair of tapered wedge shaped strips containing tapers one located on each of said supporting side walls and being located in a position in the path of travel of said valve actuator means and being spaced from said valve actuator means responsive to said valve actuator means being in said normal position.

15. The invention as defined in claim 14 wherein said side walls supporting said finger grip means are flexible side ways, whereby pivoting movement of said actuator means about the axis of said plastic mounting means from the unassembled position to the normal position engages the tapers of said tapered strips and temporarily spreads said side walls apart to permit said actuator means to pass beyond and be assembled into said normal position and wherein said side walls restore in position to position said tapered strips to block withdrawl of said actuator means from said normal position to said unassembled position.

16. The invention as defined in claim 14 wherein said valve actuator means contains depending sidewalls, said valve actuator means side walls being flexible side ways and said valve actuator means side walls including tapers for engaging said tapers of said tapered strips on said side walls supporting said finger grip means responsive to pivoting movement of said valve actuator means about the axis of said mounting means from the unassembled position to the normal position, whereby said tapers on said depending sidewalls of said valve actuator means temporarily compress said depending side walls toward one another to permit said valve actuator means to pass beyond and be assembled into said normal position; said valve actuator means side walls restoring in position responsive to said valve actuator means passing to said normal position; and with said tapered strips on said sidewalls supporting said finger grip means and said tapered strips on said valve actuator means sidewalls abuttingly engaging upon predetermined reverse movement of said actuator means from said normal position in the direction toward the unassembled position to thereby latch said actuator means in the assembled position.

17. The invention as defined in claim 3 wherein said spring means provides a biasing force upon said valve actuator means in a direction away from said orifice means responsive to said valve actuator means being positioned in said normal position, said biasing force being smaller than the predetermined force required to move said plug means through said orifice.

18. A self closing fluid dispensing valve comprising in a unitary body of molded plastic material:

manually operable pivotably movable valve actuator means having a normal position and an actuated position and responsive to an applied finger force for traveling over a short arcuate path to said actuated position;

fluid chamber means for confining a fluid to be dispensed, said fluid chamber means including chamber wall means for providing a barrier and said chamber wall means including an orifice to permit the passage of fluid from within to without said fluid chamber means;

plug means located in said fluid chamber means, said plug means having a normal position blocking said orifice to inhibit fluid flow through said orifice;

plug support means extending through said orifice coupled between said plug means and said valve actuator means and responsive to movement of said valve actuator means for moving said plug means to a position within said chamber means away from said normal position of said plug means over a short arcuate path along and upwardly away from the axis of said orifice, whereby fluid confined in said chamber means may exit therethrough;

spring means for biasing said valve actuator means in the normal position and operative over the range of travel of said valve actuator means for moving said valve actuator means back to the normal position responsive to the removal of finger actuated force from said valve actuator means;

means for mounting one end of said valve actuator means to said chamber wall means for angular movement there between;

said valve actuator means having a free end spaced from said one end and a underlying surface confronting said orifice in said chamber wall means and defining with said chamber wall means a spout passage for deflecting any fluid passing through said orifice through said spout passage past said free end;

said spout passage being variable in cross sectional area in dependence upon the extent of movement of said valve actuator means relative to said chamber wall means.

19. The invention as defined in claim 18 wherein said spring means comprises:

a strip of material having an elastic characteristic;

strap means hingedly connecting one end of said strip means to said chamber wall means, said strip means being integrally attached to said actuator means at the other end;

an elongate narrow bar attached to the undersurface of said strip oriented essentially parallel to and spaced a predetermined distance from said strap means, said bar protruding from the undersurface of said strip for abutting relationship with said chamber wall means to form a fulcrum position; whereby movement of said actuator means and said strip causes said strip to further bend about said fulcrum position and wherein said inherent elasticity of said strip causes said strip to provide a restoring spring like force responsive to flexure of said strip about said fulcrum position.

20. The invention as defined in claim 19 wherein said orifice is circular in cross section and is of a first predetermined diameter; said orifice including a peripherally surrounding side edge surface; and wherein said plug means is of a variable geometry, and having a front end and a back end, said back end being of a size and shape to mate with said peripherally surrounding side edge surface of said orifice and form therewith a fluid seal and said front end of said plug means having a frusto conical taper, said plug means having a circular cross section of a second predetermined diameter larger than said first predetermined diameter for requiring a first predetermined force level to move said plug through said orifice from a position outside of to within said chamber means and requiring a second predetermined level of force greater than said first predetermined force level to move said plug from within to without said chamber means through said orifice.

21. The invention as defined in claim 20 wherein said spring means is maintained in tension with said elastic strip being slightly flexed responsive to said valve actuator means being located in the normal position to create a predetermined biasing force on said valve actuator means, said biasing force being of a lesser level than said second predetermined force level required to move said plug means through said orifice.

22. The invention as defined in claim 19 further comprising: stop means for limiting movement of said valve actuator means in a direction away from said wall means to prevent fluid pressure on said plug means from forcing said plug means through said orifice.

23. The invention as defined in claim 22 wherein said orifice comprises a circular opening of a predetermined diameter; wherein said plug means comprises a circular cross section, said plug means cross section being of a diameter slightly larger than said circular opening, said plug means being capable of squeezing through said orifice in response to the application of a sufficient force on said plug means; wherein said chamber wall means further includes: circular groove means located coaxial with and of a diameter slightly greater than said orifice, said circular groove means encircling said orifice to enhance flexibility of said chamber wall in the area between said groove and orifice for permitting limited resilient axial displacement of said orifice; and further comprising: an axially projecting cylindrical rim coaxial with and extending about the periphery of said orifice, said rim projecting from said chamber wall axially within said valve chamber, said rim being of a diameter less than the diameter of said circular groove and located on said chamber wall between said circular groove and said orifice; and wherein said rim contains a tapered end surface adapted to mate with a surface of said plug means to form a fluid seal therebetween.

24. The invention as defined in claim 19 further comprising finger grip means positioned on each side of said valve actuator means and supported by said wall means for providing a support.

25. The invention as defined in claim 20, wherein said chamber wall means further includes: circular groove means located coaxial with and of a diameter slightly greater than said orifice, said circular groove means encircling said orifice to enhance flexibility of said chamber wall in the area between said groove and orifice for permitting limited resilient axial displacement of said orifice.

26. The invention as defined in claim 25, further comprising: an axially projecting cylindrical rim coaxial with and extending about the periphery of said orifice, said rim projecting from said chamber wall axially within said valve chamber, said rim being of a diameter less that the diameter of said circular groove and located on said chamber wall between said circular groove and said orifice.

27. The invention as defined in claim 18 wherein said spring means comprises leaf spring means for providing a biasing force storing force responsive to bending.

28. The invention as defined in claim 18 wherein said orifice comprises a circular opening of a predetermined diameter; wherein said plug means comprises a circular cross section, said plug means cross section being of a diameter slightly larger than said circular opening, said plug means being capable of squeezing through said orifice in response to the application of a sufficient force on said plug means; and wherein said chamber wall means further includes: circular groove means located coaxial with and of a diameter slightly greater than said orifice, said circular groove means encircling said orifice to enhance flexibility of said chamber wall in the area between said groove and orifice for permitting limited resilient axial displacement of said orifice; and further comprising: an axially projecting cylindrical rim coaxial with and extending about the periphery of said orifice, said rim projecting from said chamber wall axially within said valve chamber, said rin being of a diameter less than the diameter of said circular groove and located on said chamber wall between said circular groove and said orifice.

29. A self closing valve comprising a unitary molded assembly of plastic material, including:

a valve body; said valve body including fluid orifice means;

valve actuator arm means, said valve actuator arm means having an unassembled position, a normal position and an operated position;

plug means for closing said orifice means responsive to said valve actuator arm means being in said normal position;

stem means connecting said plug means to said valve actuator arm means, whereby said plug means moves in response to movement of said valve actuator arm means;

hinge joint means, said hinge joint means pivotably connecting said valve actuator arm means to said valve body;

spring means for providing a biasing force on said valve actuator arm means responsive to said valve actuator arm means being in the normal or operated position;

said valve actuator arm means being responsive to application of a manual force for pivotally moving about said hinge joint means over an arcuate path from said unassembled position through said normal position to an operated position to force said plug means through said orifice means temporarily resiliently expanding said orifice means to allow passage of said plug means therethrough and responsive to release of said force to seat said plug means in said orifice means for closing said orifice means, said orifice means restraining said plug means from moving back through said orifice means resisting said biasing force applied by said spring means; and stop limiter means, located spaced from said orifice means, for preventing said plug means from moving back through said orifice means, whereby an additional force applied to said plug means in an amount greater than said biasing force applied by said spring means does not cause said valve actuator arm means to move to said unassembled position.

30. The invention as defined in claim 29 wherein said orifice means comprises:

a circular opening of a predetermined diameter; wherein said plug means comprises:

a circular cross section, said plug means cross section being of a diameter slightly larger than said circular opening, said plug means being capable of squeezing through said orifice means in response to the application of a sufficient force on said plug means; and wherein said valve body further includes:

circular groove means located coaxial with and of a diameter slightly greater than said orifice means, said circular groove means encircling said orifice to enhance flexibility of said chamber wall in the area between said groove and said orifice means for permitting limited resilient axial displacement of said orifice means; and further comprising:

an axially projecting cylindrical rim coaxial with and extending about the periphery of said orifice means, said rim being of a diameter less that the diameter of said circular groove means and located on said valve body in space between said circular groove means and said orifice means.

31. In a self closing dispensing valve for use in dispensing liquid from a container, which valve contains a valve body, means for coupling said valve body to the portion of a fluid confining container for normally subjecting the valve body to hydrostatic pressure of confined fluid, and manually movable valve actuator means, including plug means, having a normal position and a fully operated position and responsive to the application of a manually applied force for opening the valve to dispense liquid under force of gravity from the lower section of the container; and leaf spring means for restoring said valve actuator means to the normal position from any position beyond said normal position through said fully operated position responsive to withdrawal of said applied force, the improvement therein wherein said valve body, said means for coupling said valve body, said manually movable valve actuator means with said included plug means and said leaf spring means comprises a unitary molded assembly of plastic material.

32. In a one piece self closing dispensing valve of molded plastic material for use in dispensing liquid from a container, which valve contains a valve body, means for coupling said valve body to the portion of a fluid confining container for normally subjecting the valve body to hydrostatic pressure of confined fluid, and manually movable valve actuator means having a normal position and a fully operated position and responsive to the application of a manually applied force for opening the valve to dispense liquid under force of gravity from the lower section of the container, the improvement therein comprising: leaf spring means for restoring said valve actuator means to the normal position from any position beyond said normal position through said fully operated position responsive to withdrawal of said applied force, said leaf spring means comprising: a strip of elastic plastic material pivotally attached at one end to said valve body; a narrow bar spaced between the ends of said strip proximate said pivotally attached end and oriented transverse thereto, said bar forming an abutment between said strip and said valve body, whereby said strip is permitted to be flexed over said bar.

33. The invention as defined in claim 32 further comprising in combination: limiter means coupled to said valve actuator means for limiting movement of said valve actuator means toward said valve body; and an abutment on said valve body adapted to engage said bar for preventing said bar from sliding toward said pivotally attached end of said strip responsive to flexing of said strip over said bar.

34. The invention as defined in claim 32 further comprising in combination: finger grip means connected to said valve body and located proximate said valve actuator means for providing a finger grip surface to facilitate application of force to said valve actuator means.

35. The invention as defined in claim 32 wherein said molded plastic material comprises injection molded plastic material.

36. The invention as defined in claim 32 which further comprises: hinge means coupling said valve actuator means to said valve body.

37. The invention as defined in claim 36 in which said hinge means comprises a spring like quality or characteristic.

38. The invention as defined in claim 36 wherein said hinge means comprises a living type hinge.

39. The invention as defined in claim 32 further comprising in combination: gas barrier means covering at least a portion of said valve means for inhibiting migration of gas through said valve means by osmosis type action.

40. The invention as defined in claim 39 wherein said gas barrier means comprises a coating of wax.

41. The invention as defined in claim 39 wherein said gas barrier means comprises further a coating of polyvinyl alcohol.

42. In a one piece self closing dispensing valve of molded plastic material for use in dispensing liquid from a container, which valve contains a valve body, means for coupling said valve body to the portion of a fluid confining container for normally subjecting the valve body to hydrostatic pressure of confined fluid, and manually movable valve actuator means having a normal position and a fully operated position and responsive to the application of a manually applied force for opening the valve to dispense liquid under force of gravity from the lower section of the container, the improvement therein comprising: leaf spring means for restoring said valve actuator means to the normal position from any position beyond said normal position through said fully operated position responsive to withdrawal of said applied force; and further comprising: interlock means coupled to said valve actuator means for limiting movement of said actuator means away from said valve body.

43. In a self closing dispensing valve for use in dispensing liquid from a container, which valve contains a valve body, means for coupling said valve body to the portion of a fluid confining container for normally subjecting the valve body to hydrostatic pressure of confined fluid, and manually movable valve actuator means having a normal position and a fully operated position and responsive to the application of a manually applied force for opening the valve to dispense liquid under force of gravity from the lower section of the container; and leaf spring means for restoring said valve actuator means to the normal position from any position beyond said normal position through said fully operated position responsive to withdrawal of said applied force, the improvement therein wherein said valve body, said means for coupling said valve body, said manually movable valve actuator means and said leaf spring means comprises a unitary molded assembly of plastic material and wherein said valve actuator means includes a underside surface for deflecting fluid dispensed from said container in a downward direction to exit said valve.

44. The invention as defined in claim 43 further comprising in combination: vent means for venting said underside surface of said valve actuator means.

45. In a self closing dispensing valve for use in dispensing liquid from a container, which valve contains a valve body, means for coupling said valve body to the portion of a fluid confining container for normally subjecting the valve body to hydrostatic pressure of confined fluid, and manually movable valve actuator means having a normal position and a fully operated position and responsive to the application of a manually applied force for opening the valve to dispense liquid under force of gravity from the lower section of the container; and leaf spring means for restoring said valve actuator means to the normal position from any position beyond said normal position through said fully operated position responsive to withdrawal of said applied force, the improvement therein wherein said valve body, said means for coupling said valve body, said manually movable valve actuator means and said leaf spring means comprises a unitary molded assembly of plastic material and further comprising: limiter means coupled to said valve actuator means for limiting movement of said valve actuator means in a first direction toward said valve body; interlock means coupled to said valve actuator means for limiting movement of said valve actuator means in a second direction away from said valve body; finger grip means connected to said valve body and located proximate said valve actuator means for facilitating application of force to said valve actuator means; and wherein said valve actuator means includes a surface for deflecting fluid dispensed from said container in a downward direction to exit said valve.

46. In a self closing dispensing valve for use in dispensing liquid from a container, which valve contains a valve body, means for coupling said valve body to the portion of a fluid confining container for normally subjecting the valve body to hydrostatic pressure of confined fluid, and manually movable valve actuator means having a normal position and a fully operated position and responsive to the application of a manually applied force for opening the valve to dispense liquid under force of gravity from the lower section of the container and leaf spring means for restoring said valve actuator means to the normal position from any position beyond said normal position through said fully operated position responsive to withdrawal of said applied force, the improvement therein wherein said valve body, said means for coupling said valve body, said manually movable valve actuator means and said leaf spring means comprises a unitary molded assembly of plastic material; and wherein said leaf spring means comprises: a strip of elastic plastic material pivotally attached at one end to the valve body; a narrow bar spaced between the ends of said strip proximate said pivotally attached end and oriented transverse thereto, said bar forming an abutment between said strip and said valve body, whereby said strip may be flexed over said bar; and further including in combination:

limiter means coupled to said actuator means for limiting movement of said actuator means in a first direction toward said valve body;

interlock means coupled to said actuator means for limiting movement of said actuator means in a second direction away from said valve body;

finger grip means connected to said valve body and located proximate said actuator means for facilitating application of force to said actuator means;

hinge means for connecting said strip to said valve body, said hinge means having a spring like characteristic; and gas barrier means covering at least a portion of said plastic material for inhibiting migration of gas through said valve by osmosis type action;

and wherein said valve actuator means contains a surface for deflecting fluid dispensed from said container in a downward direction to exit said valve.

47. In a self closing normally closed fluid dispensing valve of the kind including a wall, said wall including an orifice; a movable valve actuator member for opening the valve to permit the passage of fluid therethrough responsive to said valve actuator member being moved to an operated position under application of a manually applied force, said valve actuator member being movable from a normal position to an operated position; a plug coupled to said actuator member for movement therewith for blocking said orifice responsive to said actuator being in the normal position and unblocking said orifice responsive to said actuator being in the operated position; said actuator member being located on one side of said wall and said plug being located on the opposite side of said wall; and spring means for applying a force to said valve actuator member to move said valve actuator member from said operated position to the normal position responsive to withdrawal of said manually applied force, the improvement therein wherein at least said valve actuator member, plug, wall and spring means comprise: a unitary molded assembly of plastic material; and further including: means for preventing said plug from being moved from said opposite side of said wall to said one side of said wall at which said actuator member is located, whereby force applied to said plug by fluid confined by the valve is prevented from unblocking said orifice.

48. The invention as defined in claim 47 wherein said plug is initially positioned on said one side of said wall and is movable from said one side of said wall through said orifice to said other side of said wall responsive to application of a force on said plug sufficient in magnitude to resiliently temporarily expand said orifice.

* * * * *